US007954531B2

(12) United States Patent
Yuyama et al.

(10) Patent No.: US 7,954,531 B2
(45) Date of Patent: Jun. 7, 2011

(54) LABELING APPARATUS

(75) Inventors: Shoji Yuyama, Toyonaka (JP); Katsunori Yoshina, Toyonaka (JP)

(73) Assignee: Yuyama Mfg. Co., Ltd., Osaka (JP)

( * ) Notice: Subject to any disclaimer, the term of this patent is extended or adjusted under 35 U.S.C. 154(b) by 776 days.

(21) Appl. No.: 10/587,863

(22) PCT Filed: Jan. 20, 2005

(86) PCT No.: PCT/JP2005/000658

§ 371 (c)(1),
(2), (4) Date: Sep. 29, 2006

(87) PCT Pub. No.: WO2005/073092

PCT Pub. Date: Aug. 11, 2005

(65) Prior Publication Data

US 2007/0163717 A1 Jul. 19, 2007

(30) Foreign Application Priority Data

Jan. 30, 2004 (JP) ..... 2004-024669

(51) Int. Cl.

| | |
|---|---|
| ***B65C 9/06*** | (2006.01) |
| ***B65C 9/08*** | (2006.01) |
| ***B65C 9/20*** | (2006.01) |
| ***B65C 9/26*** | (2006.01) |
| ***B65C 9/34*** | (2006.01) |
| ***B65C 9/36*** | (2006.01) |
| *B65C 9/18* | (2006.01) |
| *B65C 9/30* | (2006.01) |
| *B65C 9/04* | (2006.01) |
| *B65C 3/06* | (2006.01) |
| *B65C 3/02* | (2006.01) |

(52) U.S. Cl. ..... 156/447; 156/446; 156/449; 156/455

(58) Field of Classification Search ..... 156/446–451, 156/455, DIG. 11, DIG. 13, DIG. 33, DIG. 39, 156/DIG. 40

See application file for complete search history.

(56) References Cited

U.S. PATENT DOCUMENTS 2,495,174 A * 1/1950 McClatchie ..... 156/451

(Continued)

FOREIGN PATENT DOCUMENTS

EP 1 179 475 2/2002

(Continued)

OTHER PUBLICATIONS

Notification of Reason for Refusal dated Oct. 8, 2009 in corresponding Japanese Patent Application No. 2004-024669 (with English translation).

(Continued)

*Primary Examiner* — Sonya Mazumdar

(74) *Attorney, Agent, or Firm* — Wenderoth, Lind & Ponack, L.L.P.

(57) ABSTRACT

A labeling apparatus of the present invention is constituted by: at least three support rollers which come into contact with the outer surface of the vial to rotate; an arm for rotatably supporting the support rollers; a rotation unit (rotation rollers) for rotating the vial held by the support rollers; a label supply unit for supplying labels to be attached on the outer surface of the vial; and an endless member which rotates according to the rotation of the vial between a first support roller with which the label fed from the label supply unit comes into contact first and a second support roller with which the label comes into contact second.

6 Claims, 14 Drawing Sheets

U.S. PATENT DOCUMENTS

| | | | | | |
|---|---|---|---|---|---|
| 2,639,830 | A | * | 5/1953 | Weimont | 156/353 |
| 3,607,568 | A | * | 9/1971 | Laub, III | 156/453 |
| 3,765,991 | A | * | 10/1973 | Hoffmann | 156/521 |
| 3,834,963 | A | | 9/1974 | Hoffman | |
| 4,851,072 | A | * | 7/1989 | Kontz | 156/453 |
| 5,879,496 | A | * | 3/1999 | Bright et al. | 156/86 |
| 5,946,883 | A | * | 9/1999 | Yuyama et al. | 53/154 |
| 6,581,355 | B1 | | 6/2003 | Yuyama et al. | |

FOREIGN PATENT DOCUMENTS

| | | | |
|---|---|---|---|
| GB | 1342680 | * | 1/1974 |
| JP | 54-2558 | | 2/1979 |
| JP | 57-175545 | | 10/1982 |
| JP | 57175545 A | * | 10/1982 |
| JP | 2001-130504 | | 5/2001 |
| WO | 01/32508 | | 5/2001 |

OTHER PUBLICATIONS

Decision of Refusal dated Mar. 9, 2010 in corresponding Japanese Patent Application No. 2004-024669 (with English translation).

* cited by examiner

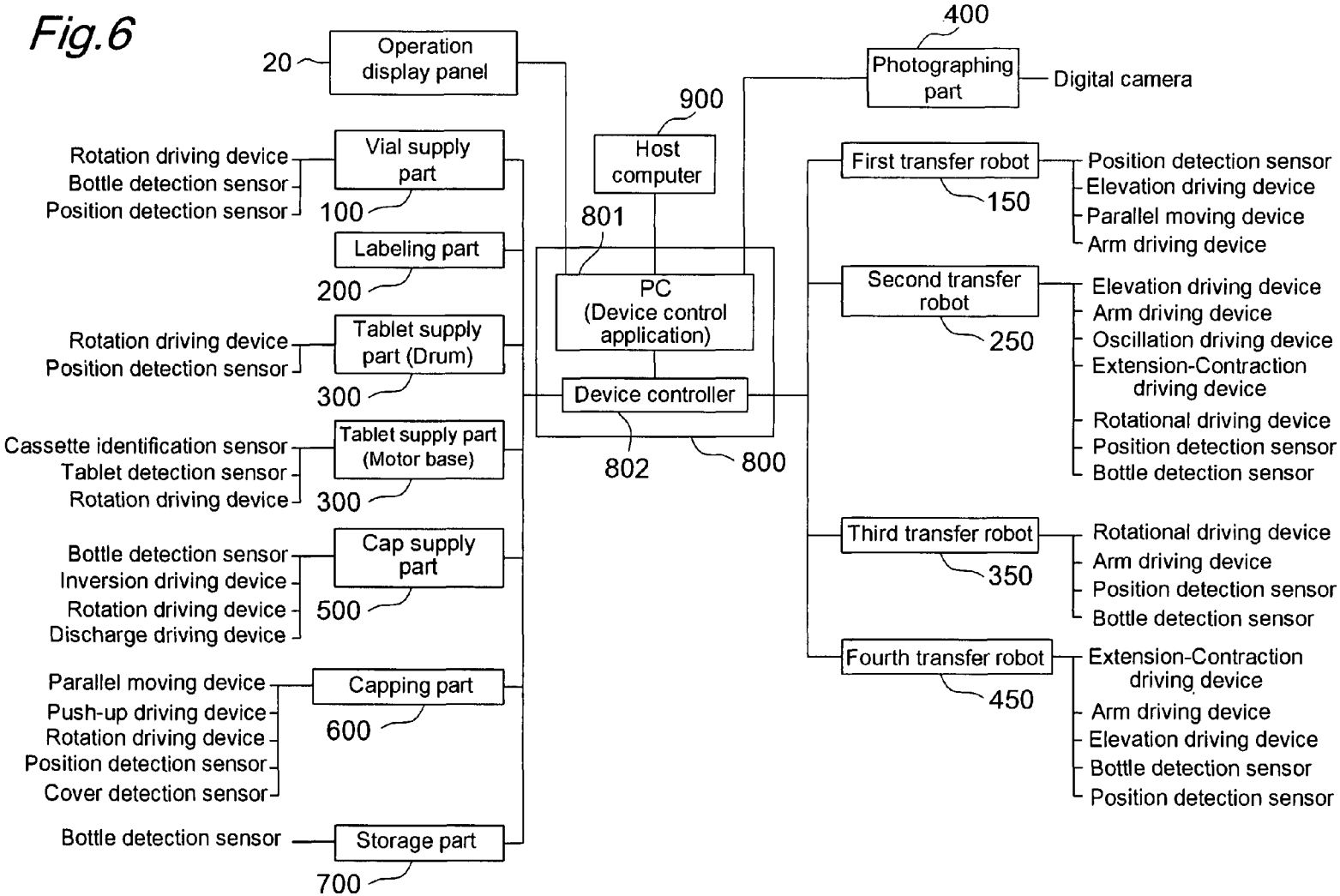
Fig.6
Photographing part
400
Digital camera
First transfer robot
150
Position detection sensor
Elevation driving device
Parallel moving device
Arm driving device
Second transfer robot
250
Elevation driving device
Arm driving device
Oscillation driving device
Extension-Contraction driving device
Rotational driving device
Position detection sensor
Bottle detection sensor
Third transfer robot
350
Rotational driving device
Arm driving device
Position detection sensor
Bottle detection sensor
Fourth transfer robot
450
Extension-Contraction driving device
Arm driving device
Elevation driving device
Bottle detection sensor
Position detection sensor
Host computer
900
PC (Device control application)
801
Device controller
802
800
Operation display panel
20
Vial supply part
100
Rotation driving device
Bottle detection sensor
Position detection sensor
Labeling part
200
Tablet supply part (Drum)
300
Rotation driving device
Position detection sensor
Tablet supply part (Motor base)
300
Cassette identification sensor
Tablet detection sensor
Rotation driving device
Cap supply part
500
Bottle detection sensor
Inversion driving device
Rotation driving device
Discharge driving device
Capping part
600
Parallel moving device
Push-up driving device
Rotation driving device
Position detection sensor
Cover detection sensor
Storage part
700
Bottle detection sensor

LABELING APPARATUS

BACKGROUND OF THE INVENTION

I. Field of the Invention

The present invention relates to a labeling apparatus in a tablet storing and dispensing apparatus.

II. Description of the Related

Prior art publication information relating to the labeling apparatus of the present invention is as follow.

The labeling apparatus of Japanese Unexamined Patent Application Publication 2001-130504 (JP '504) is provided with a storage shelf, a tablet supply section, a tablet vessel supply section, a tablet filling section and a label attaching section.

The label attaching section is a section that a label on which a tablet name and so on is printed is attached on a vial. The label to be attached on the vial in the tablet attaching section after printed by a print head is peeled from a sheet by a guide tip provided at an end portion of the tablet attaching section as the sheet is turned. Then, only the peeled label advances toward the vial.

In the label attaching section, in the vicinity of the position where the peeled label advances, a rotation roller which is rotated by a motor is provided so that the rotation force is transmitted to the vial. A support member of the vial is positioned near the rotation roller. A pair of push rollers is disposed on the support member so as to form an isosceles triangle together with the rotation roller.

In the label attaching section constructed as described above, the advancing label comes into contact with the outer surface of the vial to adhere to the vial. The rotation of the vial due to the rotation roller allows all the surfaces of the label to be attached on the vial.

SUMMARY OF THE INVENTION

However, the adhesion of the label is not stable just after being attached on the vial. So, the tip end of the label is likely to be peeled from the vial due to stiffness itself. If the vial is rotated in a state that the tip end of the label is peeled and free, there is a possibility that the label adheres to the push rollers.

Therefore, it is an object of the present invention to provide a labeling apparatus in which the label can be securely attached on the outer surface of the vial.

In order to solve the above problems, a labeling apparatus according to the present invention, comprises:

- at least three support rollers which come into contact with the outer surface of the vial to rotate;
- an arm for rotatably supporting the support rollers;
- rotation means or unit for rotating the vial held by the support rollers in a predetermined direction;
- label supply means for supplying labels to be attached on the outer surface of the vial; and
- an endless member which rotates according to the rotation of the vial between a first support roller and a second support roller, the first support roller being one with which the label fed from the label supply means comes into contact first, the second support roller being one with which the tip end of the label that is in an attaching process in accordance with the rotation of the vial comes into contact secondary.

In the labeling apparatus, each of the support rollers is preferably divided into an upper part and a lower part within a range of the height of the vial.

Here, the element of "at least three support rollers which come into contact with the outer surface of the vial to rotate" includes all constructions that more than three support rollers are disposed so as to form a locus of a circle such as a construction that three support rollers are disposed at regular intervals to form an equilateral triangle, a construction that three support rollers are disposed to form an irregular triangle such as isosceles triangle, a construction that four support rollers are disposed at regular intervals to form a quadrate, and a construction that four support rollers are disposed at irregular intervals to form a quadrangle.

The element of "an endless member which rotates according to the rotation of the vial" means one having a loop shape. The width and thickness are not limited.

The support roller "divided into an upper part and a lower part within a range of the height of the vial" means one in which rollers with short total length are vertically disposed on the same axis.

In the labeling apparatus according to the present invention, the endless member rotates according to the rotation of the vial between the first support roller with which the label comes into contact first and the second support roller with which the label with which the label comes into contact second, preventing the tip end of the label from being peeled from the vial due to stiffness. As a result, the label is continuously pressed on the vial as the label is guided to the support rollers, allowing all surface of the label to be securely attached on the outer surface of the vial. Thus, it is possible to prevent the occurrence of a problem caused by the label with the tip end peeled and free adhering to the push rollers.

In addition, as each of the support rollers is one divided into an upper part and a lower part within a range of the height of the vial, the holding positions against the vial can be increased. As a result, stability of the holding condition of the vial can be enhanced.

BRIEF DESCRIPTION OF THE DRAWINGS

FIG. 6 is a block diagram of control performed by a device control apparatus;

DETAILED DESCRIPTION OF THE INVENTION

Figure 1:
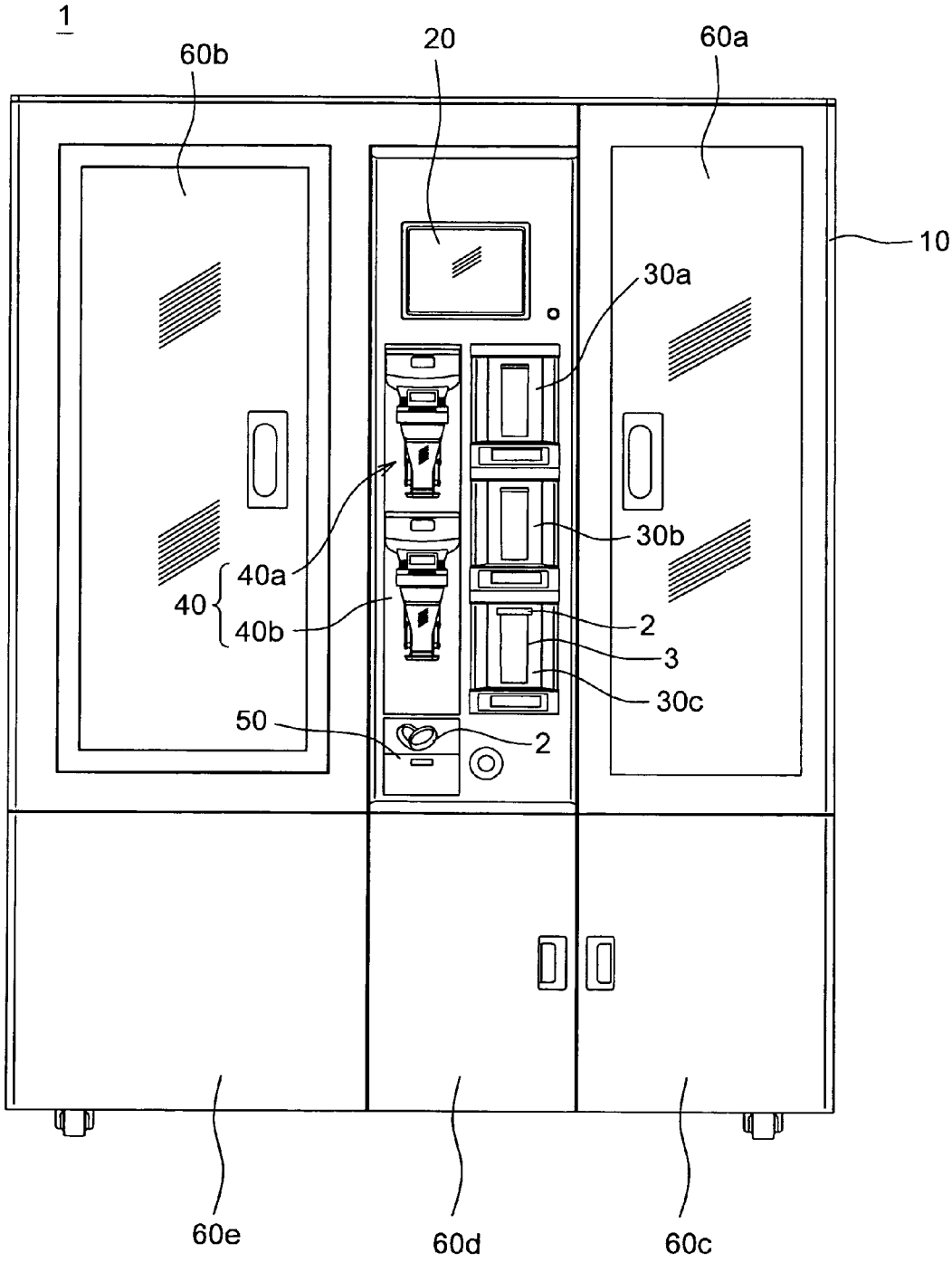
FIG. 1 is a front view of a tablet storing and dispensing apparatus according to the present invention.
Figure 2:
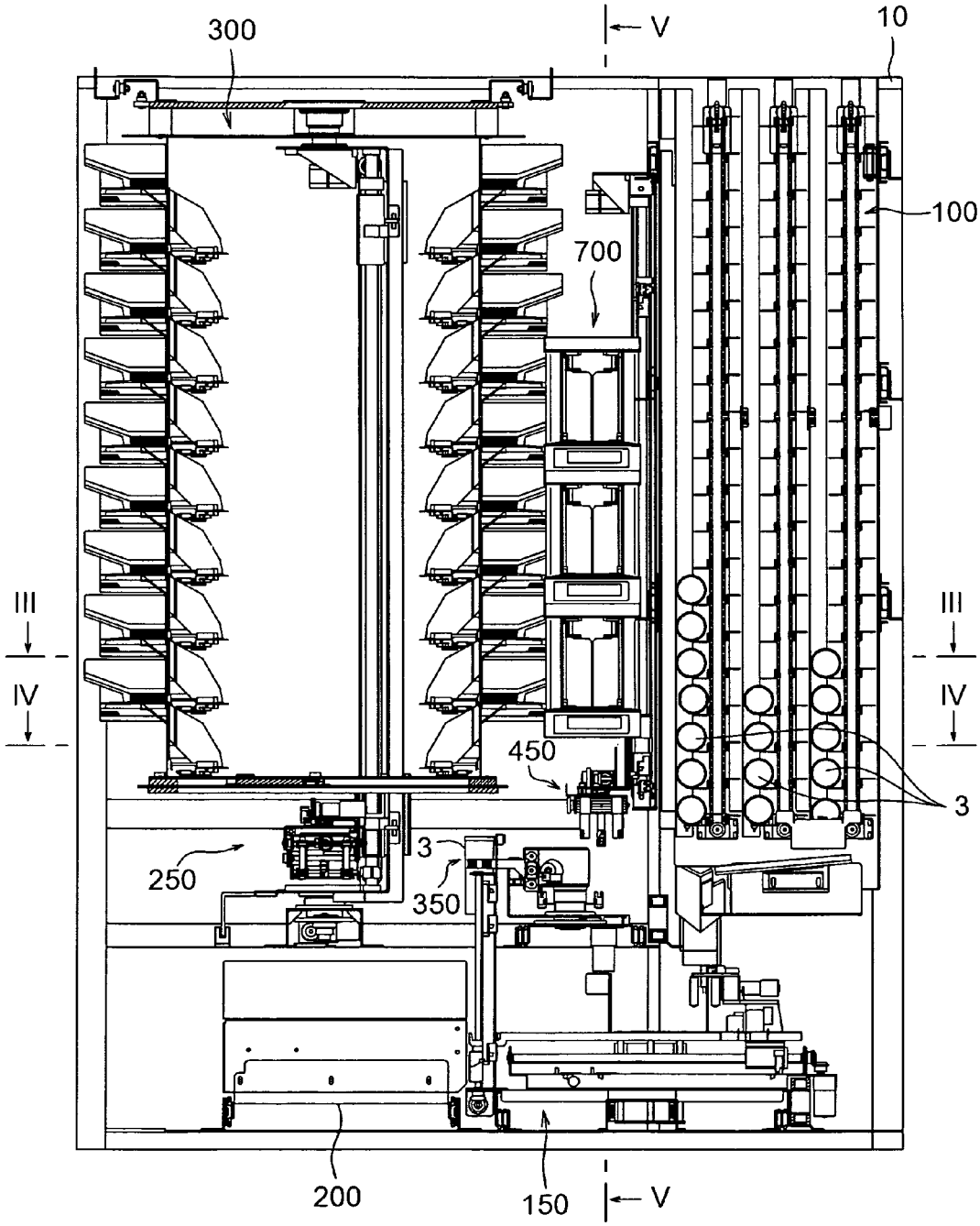
FIG. 2 is an internal front view of the tablet storing and dispensing apparatus of FIG. 1.
Figure 3:
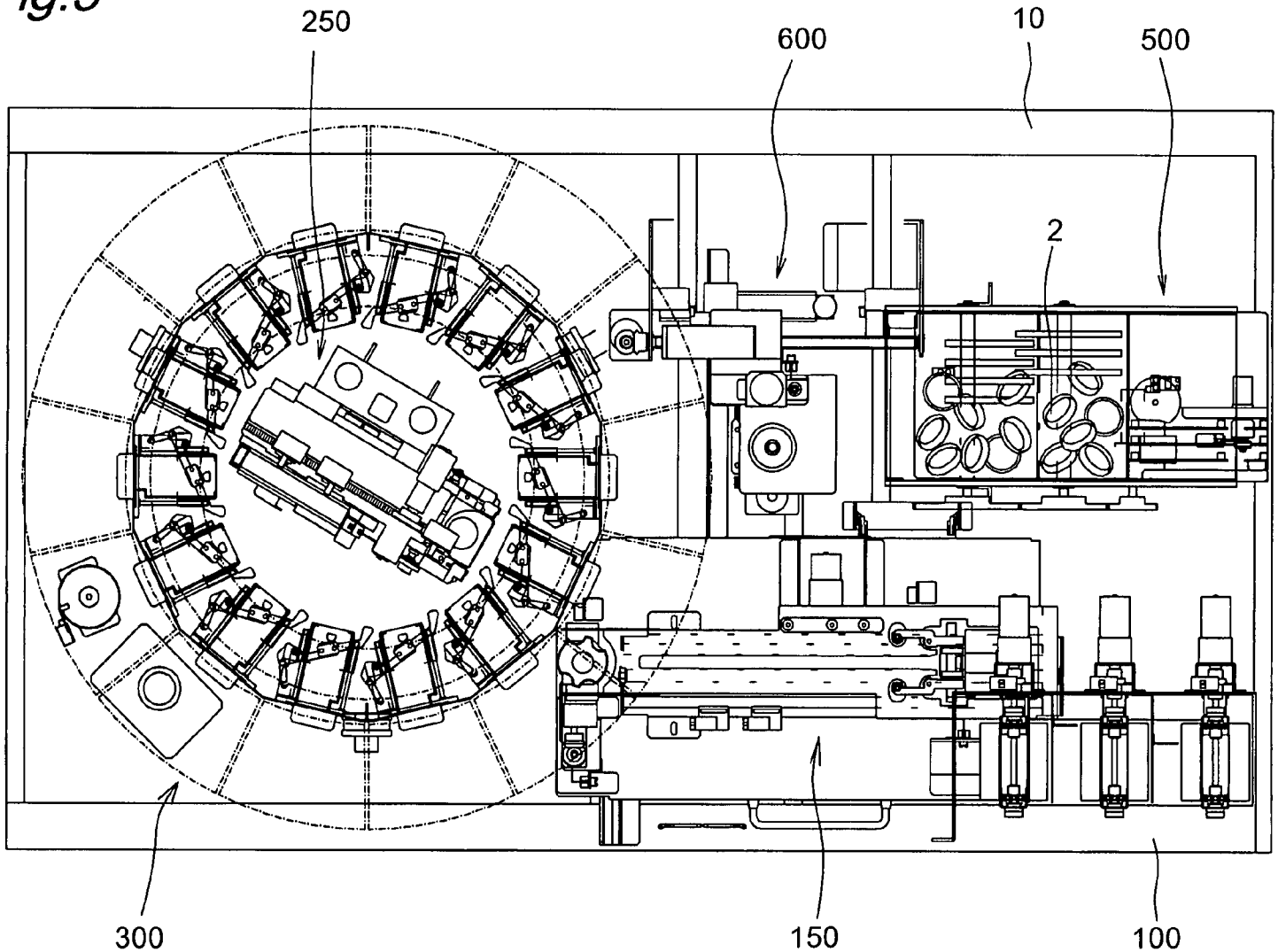
FIG. 3 is a sectional view along a line III-III of FIG. 2.
Figure 4:
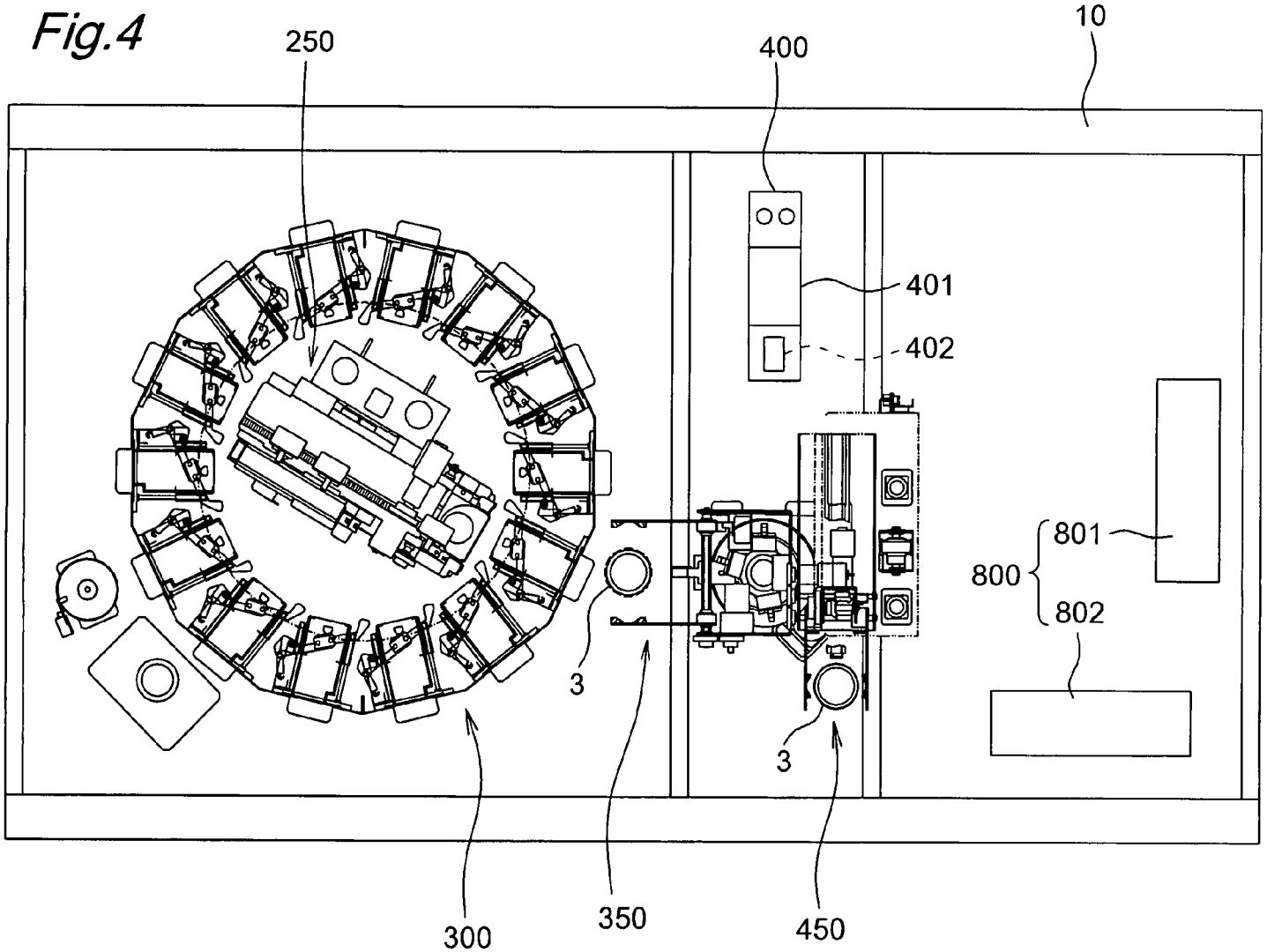
FIG. 4 is a sectional view along a line IV-IV of FIG. 2.
Figure 5:
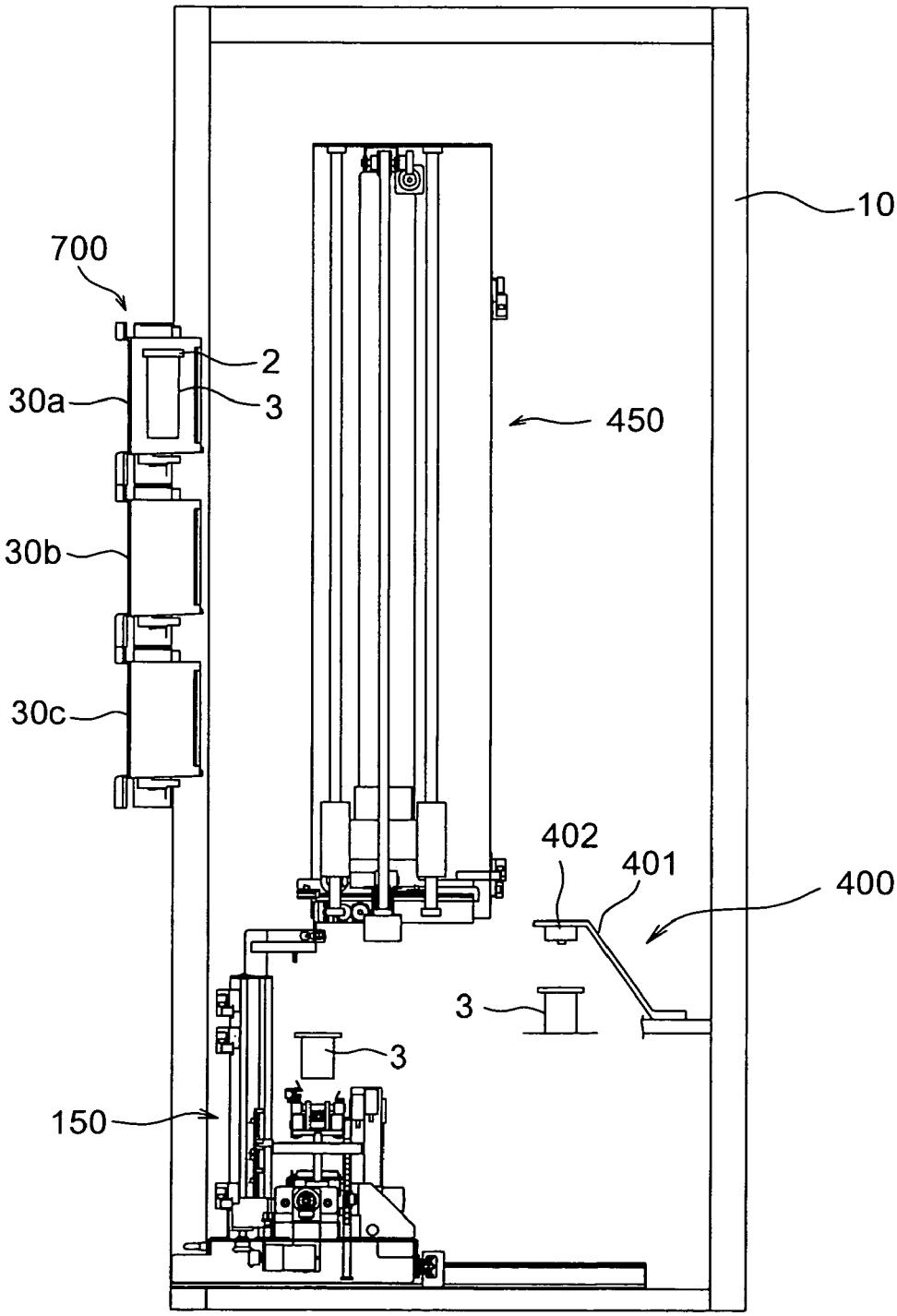
FIG. 5 is a sectional view along a line V-V of FIG. 2.

FIG. 1 is an elevation view of a tablet storing and dispensing apparatus 1 according to the invention. FIG. 2 is an elevation view of the interior of the tablet storing and dispensing apparatus 1. FIG. 3 is a cross section taken on line III-III of FIG. 2. FIG. 4 is a cross section taken on line IV-IV of FIG. 2. FIG. 5 is a cross section taken on line V-V of FIG. 2.

1. Overall Arrangement and Construction

First, a description will be given on the overall arrangement and construction of the tablet storing and dispensing apparatus 1. As shown in FIG. 1, at the upper center of a main body 10 as viewed from the front, an operation display panel 20 is provided which provides displays required for operating the tablet storing and dispensing apparatus 1. To the lower right of the operation display panel 20, three vial take-out ports 30*a*, 30*b*, and 30*c* are provided. To the lower left thereof are provided auxiliary tablet supply parts 40 (40*a*, 40*b*), under which an auxiliary cap storage part 50 is provided. The auxiliary tablet supply parts 40 store two different kinds of pyrazolone tablets respectively, and supply tablets in accordance with prescription data. The auxiliary cap storage part 50 randomly stores a large number of caps 2 and permits them to be manually taken out when necessary. At the upper right side of the tablet storing and dispensing apparatus 1 as viewed from the front is provided a door 60*a* for replacing a vial 3. At the left side thereof is provided a door 60*b* for replacing and refilling tablets. At the bottom thereof are also provided doors 60*c*, 60*d*, and 60*e* for maintenance.

Inside the tablet storing and dispensing apparatus 1, as shown in FIGS. 2, 3, 4, and 5, there are provided: a vial supply part 100, a labeling part 200 served as label supply means or unit, a tablet supply part 300, a photographing part 400, a cap supply part 500, a capping part 600, and a storage part 700. The vial supply part 100 is provided on the right side of the main body 10 as viewed from the front, as shown in FIG. 2, and stores a large number of vials 3 by size and supplies, one by one, vials 3 of a size suitable for filling tablets in accordance with prescription data. The labeling part 200 is provided at the lower center of the main body 10 as viewed form the front, and puts a label with printed prescription information on a vial 3 supplied from the vial supply part 100. The tablet supply part 300 is provided on the left side of the main body 10, and stores a large number of tablets (non-pyrazolone) by type and supplies tablets in accordance with prescription data. The photographing part 400 is provided, as shown in FIG. 4, on the center back side of the main body 10, and photographs a vial 3 from above for audit of tablets filled into the vial 3. The cap supply part 500 is provided, as shown in FIG. 3, on the right side of the main body 10 and behind the vial supply part 100, and stores caps 2 for plugging the vials 3, and supplies the caps one by one. The capping part 600 is provided on the center back side of the main body 10, and plugs a vial 3, which is filled with tablets, with a cap 2 supplied from the cap supply part 500. The storage part 700, as shown in FIG. 5, stores vials 3 filled with tablets and plugged with a cap 2 so that they can be taken out by an operator through take-out ports 30*a*, 30*b*, and 30*c*.

The tablet storing and dispensing apparatus 1 is further provided, as shown in FIG. 2, with a first transfer robot 150, a second transfer robot 250, a third transfer robot 350, and a fourth transfer robot 450. The first transfer robot 150 is provided below the vial supply part 100, and can hold a vial 3 supplied from the vial supply part 100, transfer it leftward from the vial supply part 100 to the labeling part 200 in the horizontal direction of the main body, and transfer it upward from the labeling part 200 to the second transfer robot 250 or the third transfer robot 350. The second transfer robot 250 is provided inside the tablet supply part 300, and can hold a vial 3 delivered from the first transfer robot 150, transfer it to supply ports of the tablet supply part 300, and transfer it from the supply ports to the third transfer robot 350. The third transfer robot 350 is provided above the first transfer robot 150 in the main body 10, and can deliver, between the capping part 600 and the fourth transfer robot 450, a vial 3 delivered from the first transfer robot 150 or the second transfer robot 250. The fourth transfer robot 450 is provided above the third transfer robot 350, and can transfer a vial 3 delivered form the third transfer robot 350 upward to the storage part 700.

In the tablet storing and dispensing apparatus 1, as shown in FIG. 4, a control part 800 is provided on the right side of the main body 10. The control part 800 is, shown in FIG. 6, composed of: a personal computer (PC) 801 in which apparatus control applications are installed; and a device controller 802 composed of a micro computer and the like. The PC 801 is connected to a host computer 900 installed in a hospital or a drug store, and receives inputted data such as prescription data and the like. The PC 801 is also connected to the operation display panel 20, and outputs display information required for the operation of the tablet storing and dispensing apparatus 1 and also receives operation information inputted through the tough panel on the operation display panel 20. Furthermore, the PC 801 is connected to a digital camera provided in the photographing part 400. The device controller 802 is connected to sensors and driving devices of the vial supply part 100, the labeling part 200, the tablet supply part 300, the cap supply part 500, the capping part 600, and the storage part 700 so as to drive and control these parts. Moreover, the device controller 802 is connected to sensors and driving devices of the first transfer robot 150, the second transfer robot 250, the third transfer robot 350, and the fourth transfer robot 450 so as to drive and control these parts.

Next, a labeling apparatus constituted by the first transfer robot 150 and labeling part 200, in the tablet storing and dispensing apparatus 1 having the overall constitution described above, will be described in further detail. Note that the other parts are not directly related to the present invention, and hence description thereof has been omitted.

2. Constitution of First Transfer Robot 150

Figure 7:
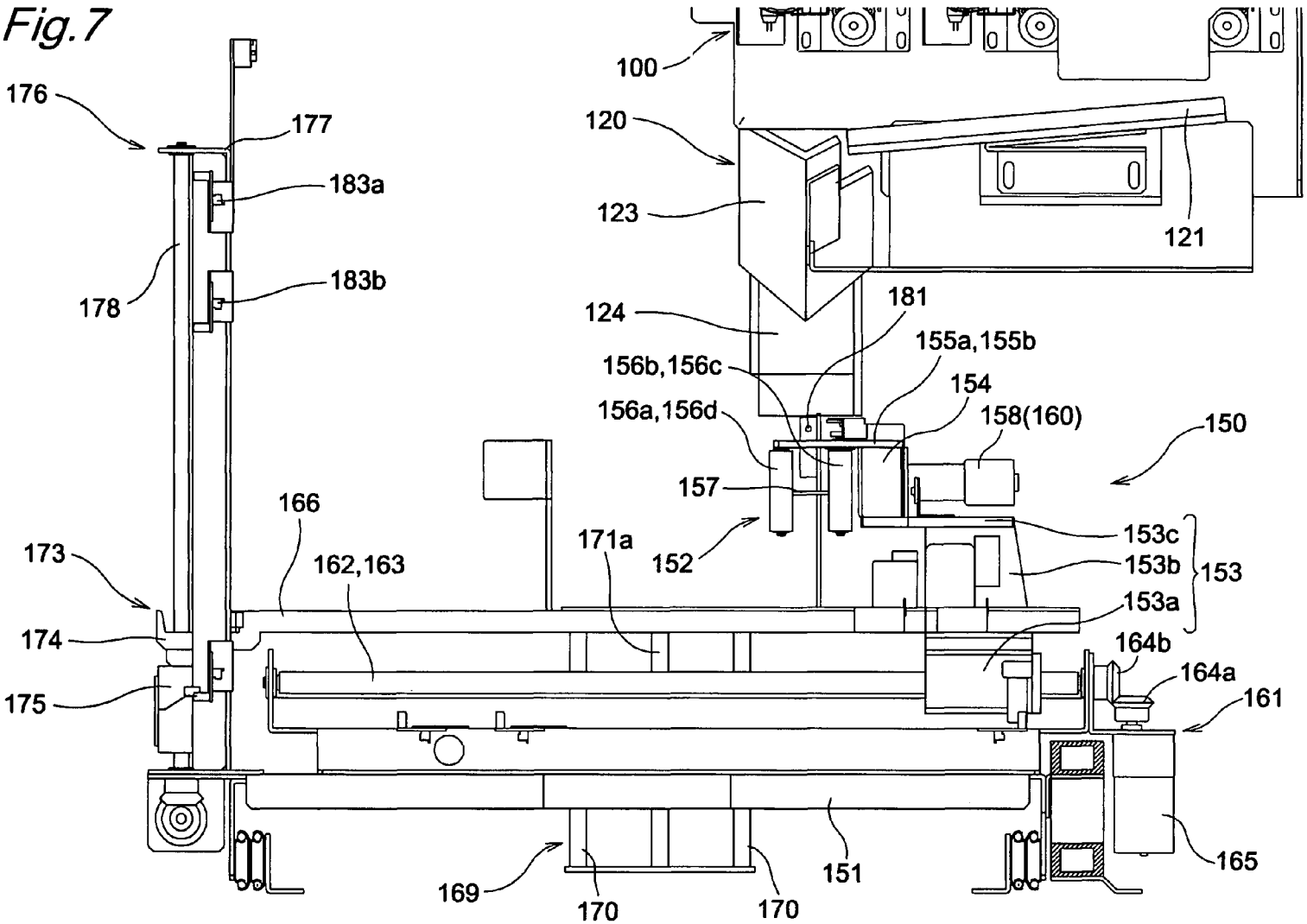
FIG. 7 is a front view of a first transfer robot.
Figure 8:
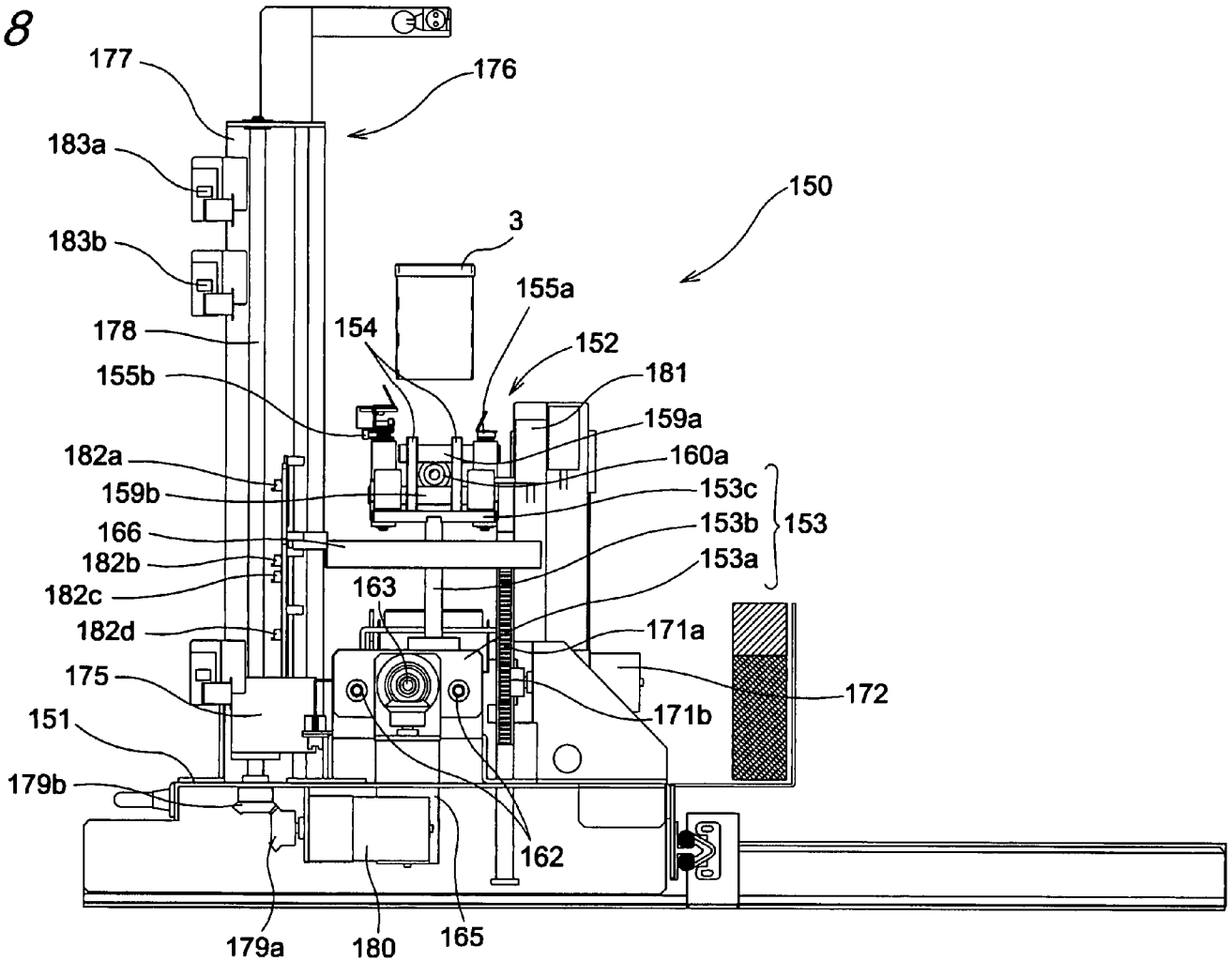
FIG. 8 is a right side view of the first transfer robot.
Figure 9:
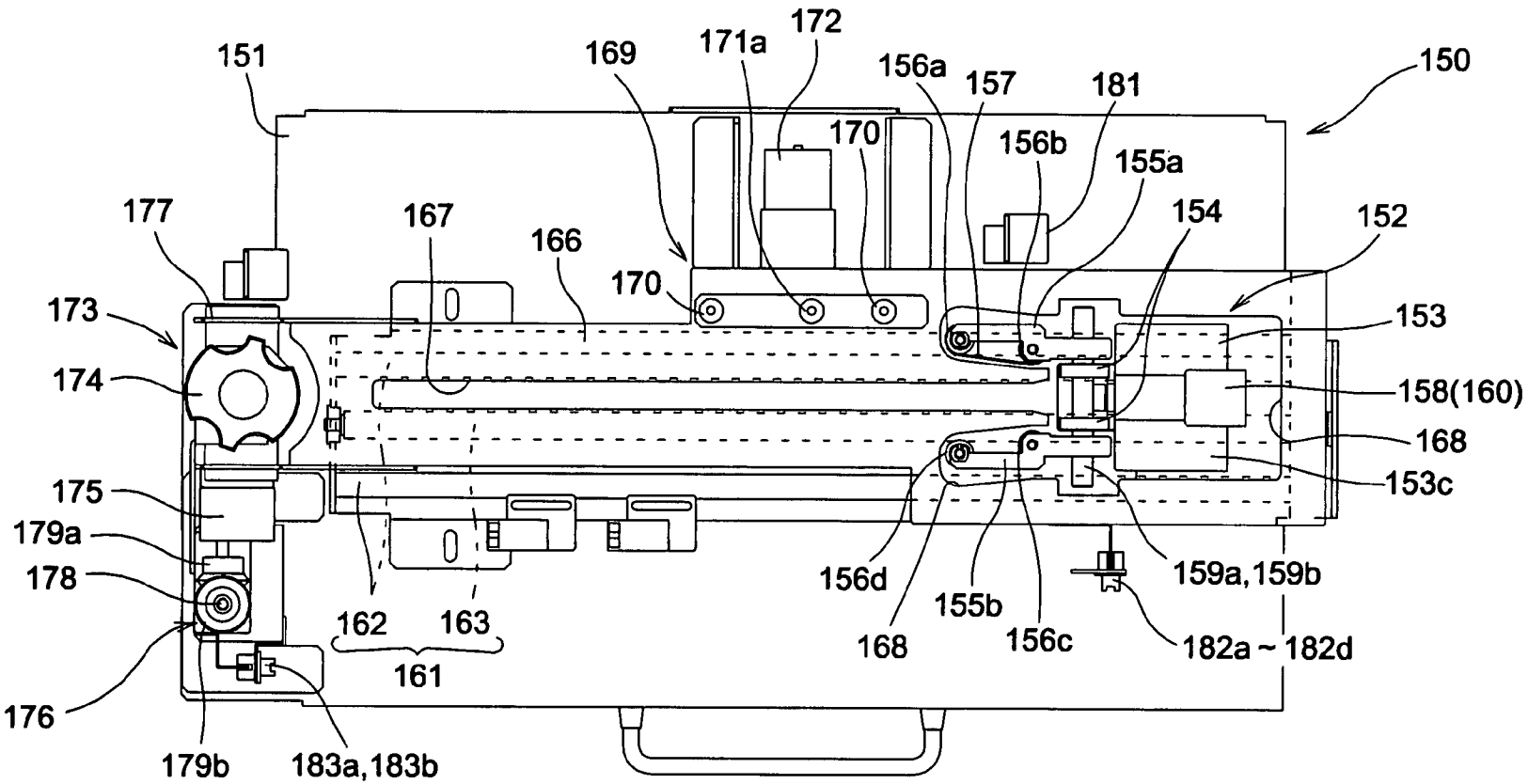
FIG. 9 is a plan view of the first transfer robot.

The first transfer robot 150, which constitutes the labeling apparatus of the present invention, as shown in FIGS. 7, 8, 9 receives the vial 3 supplied from the chute portion 120, and supplies the vial 3 to a second transfer robot 250 or a third transfer robot 350 shown in FIG. 2 via the labeling part 200.

Here, the chute portion 120, as shown in FIG. 7, which receives vial 3 supplied through the vial supply part 100, allows the vial 3 to drop with the opening of the vial 3 facing upward, and supplies the vial to the first transfer robot 150 is constituted by a vial rolling path 121, a chute 123, and a vial drop/supply path 124. The vial rolling path 121, which is inclined downwardly toward the chute 123, receives the vials 3 that are dropped and supplied through each of the supply ports of the vial supply part 100, and supplies the vials 3 to the chute 123 by rolling the vials 3 circumferentially along an incline. The chute 123, which has a V-shaped cross-section, receives the vial 3 supplied from the vial rolling path 121, and supplies the vial 3 to the vial drop/supply path 124 by sliding the vial 3 axially along an incline extending to the back surface side. The vial drop/supply path 124 is a tubular member which receives the vial 3 supplied from the chute 123, changes the direction of the vial 3 such that the axial direction of the vial 3 matches the vertical direction, and drops the vial 3.

The first transfer robot 150 which receives the vial 3 from the chute portion 120 comprises a base 151 for pulling the entire first transfer robot 150 forward during maintenance, and a robot arm 152, a parallel moving apparatus 161, an adjustment table 166, an adjustment table moving apparatus 169, an elevator table 173, and an elevator driving apparatus 176 are disposed on the base 151.

The robot arm 152 holds the vial 3 supplied from the chute portion 120, and is constituted by a pair of arms 155*a*, 155*b* disposed on a moving block 153, and an arm driving apparatus 158 for driving the arms 155*a*, 155*b*.

The moving block 153 is constituted by a base portion 153*a*, a vertical wall 153*b* which projects upward from the center of the base portion 153*a*, and an arm attachment portion 153*c* extending parallel to the base portion 153*a* from the upper end of the vertical wall 153*b*. A pair of guide holes and a screw hole, none of which are shown in the drawing, are provided in the base portion 153*a*. A bearing portion 154 is provided so as to project from the arm attachment portion 153*c*.

The parallel moving apparatus 161, which moves the entire robot arm 152 by moving the moving block 153 to the left side of the horizontal direction, is constituted by guide shafts 162 inserted through the guide holes in the base portion 153*a* of the moving block 153, a ball screw 163 disposed between the guide shafts 162 and screwed into the screw hole in the base portion 153*a*, gears 164*a*, 164*b* for rotating the ball screw 163, and a drive motor 165.

As shown in FIGS. 8 and 9, the arms 155*a*, 155*b* are positioned on the outer peripheral portion of the vial 3 and disposed at the respective ends of a pair of racks 159*a*, 159*b* disposed on the bearing portion 154 so as to constitute the arm driving apparatus 158 to be described below. First through fourth support rollers 156*a*, 156*b*, 156*c*, 156*d* for supporting the outer peripheral surface of the vial 3 in a lengthwise direction are disposed rotatably on the arms 155*a*, 155*b* so as to position at corners of substantially quadrate. An endless member 157 constituted by a rubber ring is wrapped around the first and second support rollers 156*a*, 156*b* disposed rotatably on the arm 155*a*, from among the support rollers 156*a* to 156*d*. Here, the vial 3 that is supported by the support rollers 156*a* to 156*d* is rotated by vial rotating means disposed on the labeling part 200 to be described below (see FIG. 11) such that a label 4 comes into contact with the first, second, third, and fourth support rollers 156*a* to 156*d* in sequence. Also, the label 4 is supplied to the vial 3 so as to be positioned in front of the rotation direction of the vial 3 at the first support roller 156*a*. That is to say, the endless member 157 which rotates according to the rotation of the vial 3 between a first support roller 156*a* and a second support roller 156*b* is provided. The first support roller 156*a* is one with which the label 4 fed from the labeling part 200 comes into contact firstly. The second support roller 156*b* is one with which the tip end of the label 4 that is in a attaching process in accordance with the rotation of the vial 3 comes into contact secondary.

The arm driving apparatus 158 for driving the pair of arms 155*a*, 155*b* is constituted by the pair of racks 159*a*, 159*b*, which are supported by the bearing portion 154 and have ends which protrude in respectively opposite directions (forward and rearward), and a drive motor 160 having a gear 160*a* for rotating the mutually opposing teeth of the racks 159*a*, 159*b*, which is disposed on an output shaft thereof. When the gear 160*a* rotates forwardly, the racks 159*a*, 159*b* move in a direction which causes the protruding tip ends thereof to retreat from each other, and as a result, the arms 155*a*, 155*b* approach each other. When the gear 160*a* rotates reversely, the racks 159*a*, 159*b* move in a direction which causes the protruding tip ends thereof to approach each other, and as a result, the arms 155*a*, 155*b* move away from each other.

As shown in FIGS. 7 and 8, the adjustment table 166 is disposed below the arms 155*a*, 155*b* serving as the robot arm 152 so as to be capable of moving in a vertical direction, and is constituted by a plate extending from a position to which the vial 3 falls from the chute portion 120, which serves as a start position of the robot arm 152, to the labeling part 200 which serves as a movement end position. As shown in FIG. 9, a long groove 167 for accommodating the vertical wall 153*b* of the moving block 153 is provided in the adjustment table 166 so as to extend in the lengthwise direction. Further, an insertion hole 168 into which the moving block 153 and the support rollers 156*a* to 156*d* can be inserted is provided at the start position.

As shown in FIGS. 7 and 8 the adjustment table moving apparatus 169 for raising and lowering the adjustment table 166 in the vertical direction is constituted by a pair of guide shafts 170 inserted through guide holes that are provided substantially in the center of the back surface side of the adjustment table 166, a ball screw 171*a* disposed between the guide shafts 170 and screwed into a screw hole that is provided in the adjustment table 166, a gear 171*b* for rotating the ball screw 171*a*, and a drive motor 172.

As shown in FIGS. 7 and 8, the elevator table 173 is provided at the movement end position of the robot arm 152, and is constituted by a tray portion 174 for receiving the vial 3 that is transported by the robot arm 152, and an attachment table 175 to which the tray portion 174 is attached.

As shown in FIG. 8, the elevator driving apparatus 176 for raising and lowering the attachment table 175 is constituted by a support pillar 177 extending to a transfer position to the second transfer robot 250 on the upper side thereof, a ball screw 178 disposed rotatably so as to extend between the upper and lower ends of the support pillar 177 and screwed into a screw hole provided in the attachment table 175, gears 179*a*, 179*b* for rotating the ball screw 178, and a drive motor 180.

Further, as shown in FIG. 7 an infrared sensor 181 serving as detection means for determining that the vial 3 has been supplied to the back surface side of the start position is provided on the first transfer robot 150. As shown in FIG. 8, four limit switches 182*a* to 182*d* serving as elevation position detection sensors for detecting the position of the adjustment table 166 are disposed on the front surface side of the start position. The limit switch 182*a* in the uppermost position detects the reception position of the vial 3. The limit switch 182*b* positioned therebelow detects a height adjustment position when the vial 3 having the smallest overall height is to be transported. The limit switch 182*c* positioned therebelow detects a height adjustment position when the vial 3 having the intermediate overall height is to be transported. The limit switch 182*d* in the lower most position detects a height adjustment position when the vial 3 having the greatest overall height is to be transported. Two limit switches 183*a*, 183*b* for detecting the elevation position of the elevator table 173 are disposed on the support pillar 177 in the end position. Here, the upper side limit switch 182*a* detects a transfer position to the second transfer robot 250 shown in FIG. 2, while the lower side limit switch 182*b* detects a transfer position to the third transfer robot 350.

The first transfer robot 150 constituted in this manner is operated by the device control apparatus 802 shown in FIG. 6 serving as transfer robot control means. Control of the first transfer robot 150 by the device control apparatus 802 will be described below in detail.

Figure 10:
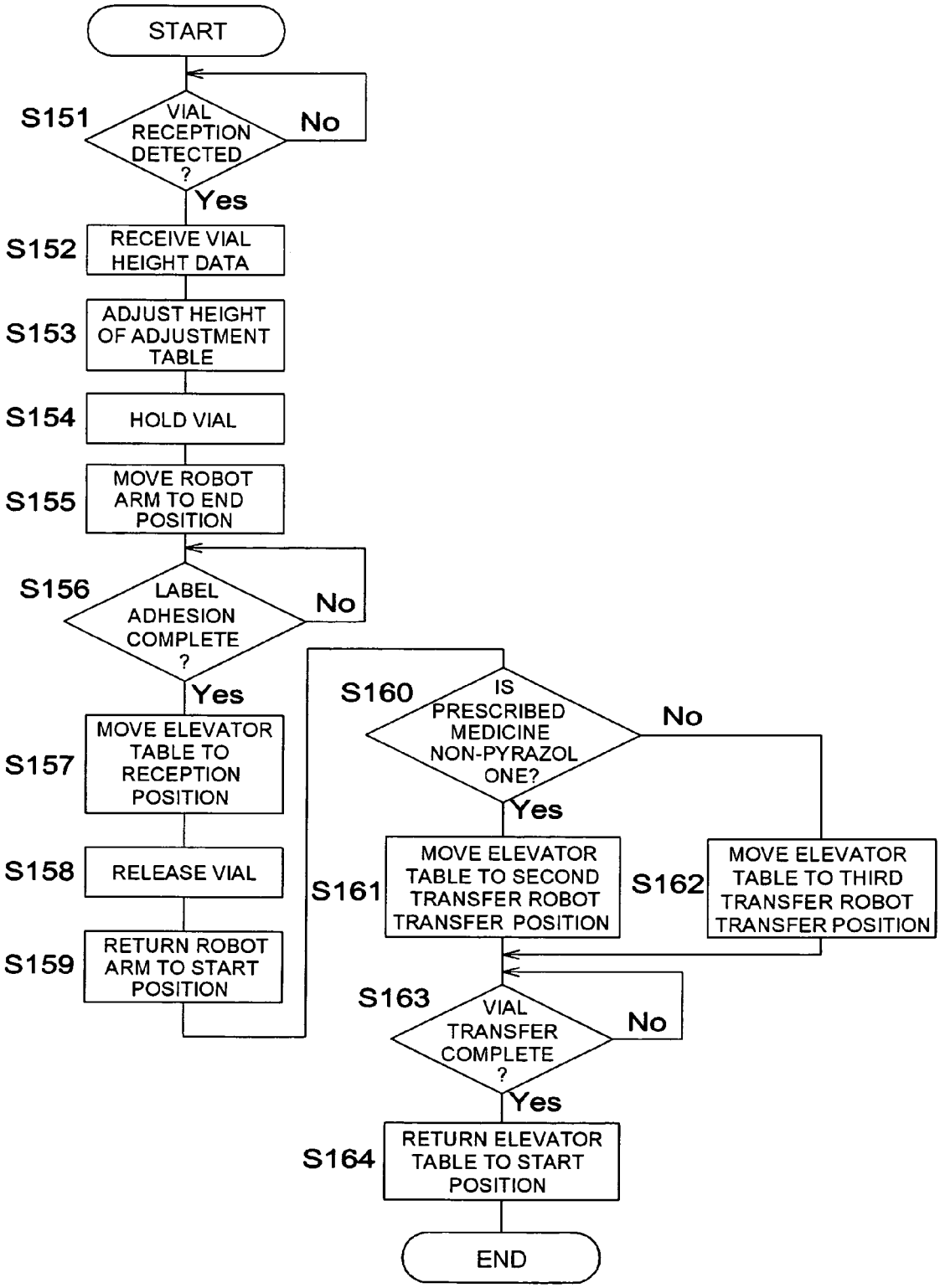
FIG. 10 is a flowchart illustrating control of the first transfer robot by the device control apparatus.

As shown in FIG. 10, in an initial step S151, the device control apparatus 802 waits for the infrared sensor 181 to detect the supply of the vial 3 from the chute portion 120 in the start position, which is the upper end position of the adjustment table 166 adjusted by the limit switch 182*a*.

When it is determined that the vial 3 has been received, in a step S 152, a most suited size of vial 3 is selected based on the size and dosing number of the tablet to be prescribed on the basis of the input prescription data and then height data relating to the vial 3 are received (read). In a step S153, the adjustment table moving apparatus 169 is operated to adjust the height of the adjustment table 166 using the limit switches 182*b* to 182*c*. As a result, the upper end positions of the differently sized vials 3 all match each other.

Next, in a step S154, the robot arm 152 is operated by the arm driving apparatus 158 to grip the vial 3, whereupon the parallel moving apparatus 161 is operated in a step S155 to move the robot arm 152 in a horizontal direction to a label affixing position, or in other words the end position.

Next, in a step S156, the device control apparatus 802 waits for the label 4 to be affixed to the outer peripheral surface of the vial 3 by the labeling part 200 to be described below, and when adhesion of the label 4 is complete, the elevator driving apparatus 176 is operated in a step S157 to raise the elevator table 173 to the transfer position (bottom) of the vial 3.

Next, in a step S158, the robot arm 152 is operated by the arm driving apparatus 158 to release the held vial 3, whereupon the parallel moving apparatus 161 and adjustment table moving apparatus 169 are operated in a step S159 to return to the start position. Note that this return operation is performed by first moving the adjustment table 166 to the lowermost position, then moving the robot arm 152 to the start position, and then moving the adjustment table 166 to the uppermost position.

Next, in a step S160, a determination is made on the basis of the prescription data as to whether or not the tablets prescribed are non-pyrazolone. When the prescribed tablets are non-pyrazolone tablets, the routine advances to a step S161, where the elevator table 173 is moved by the elevator driving apparatus 176 to a second transfer robot transfer position on the upper side. The routine then advances to a step S163. On the other hand, when the prescribed tablets are not non-pyrazolone tablets, the routine advances to a step S162, where the elevator table 173 is moved by the elevator driving apparatus 176 to a third transfer robot transfer position on the lower side. The routine then advances to the step S163.

In the step S163, the second transfer robot 250 or third transfer robot 350 holds the vial 3 and waits for the completion of transfer. When transfer is complete, the elevator table 173 is returned to the lower end start position by the elevator driving apparatus 176 in a step S164, whereupon control of the first transfer robot 150 is terminated.

Hence, as the first transfer robot 150 of the present invention is constituted to move the robot arm 152 horizontally using the parallel moving apparatus 161, an improvement in the stability of the transport operation can be achieved. Further, the first transfer robot 150 adjusts the height of the adjustment table 166 so that the upper end positions of the vials 3 having different overall heights match, and then operates the robot arm 152 to transport the vial 3. Therefore, the position in which the vial 3 is held from its upper end is constant regardless of the overall height of the vial 3, and as a result, the transfer position to the next process can be stabilized. In other words, according to this embodiment, the label affixing position in which the label 4 is affixed by the labeling part 200 to be described below is a constant distance from the upper end opening of the vial 3 regardless of the overall height of the vial 3.

Moreover, the adjustment table 166 receives the vial 3 from the chute portion 120 after being moved to the upper end position, and therefore the degree to which the vial 3 jumps up after falling naturally can be suppressed. As a result, the stability of the transfer operation from the chute portion 120 can be improved.

3. Constitution of Labeling Part 200 (Label Supply Means)

Figure 11:
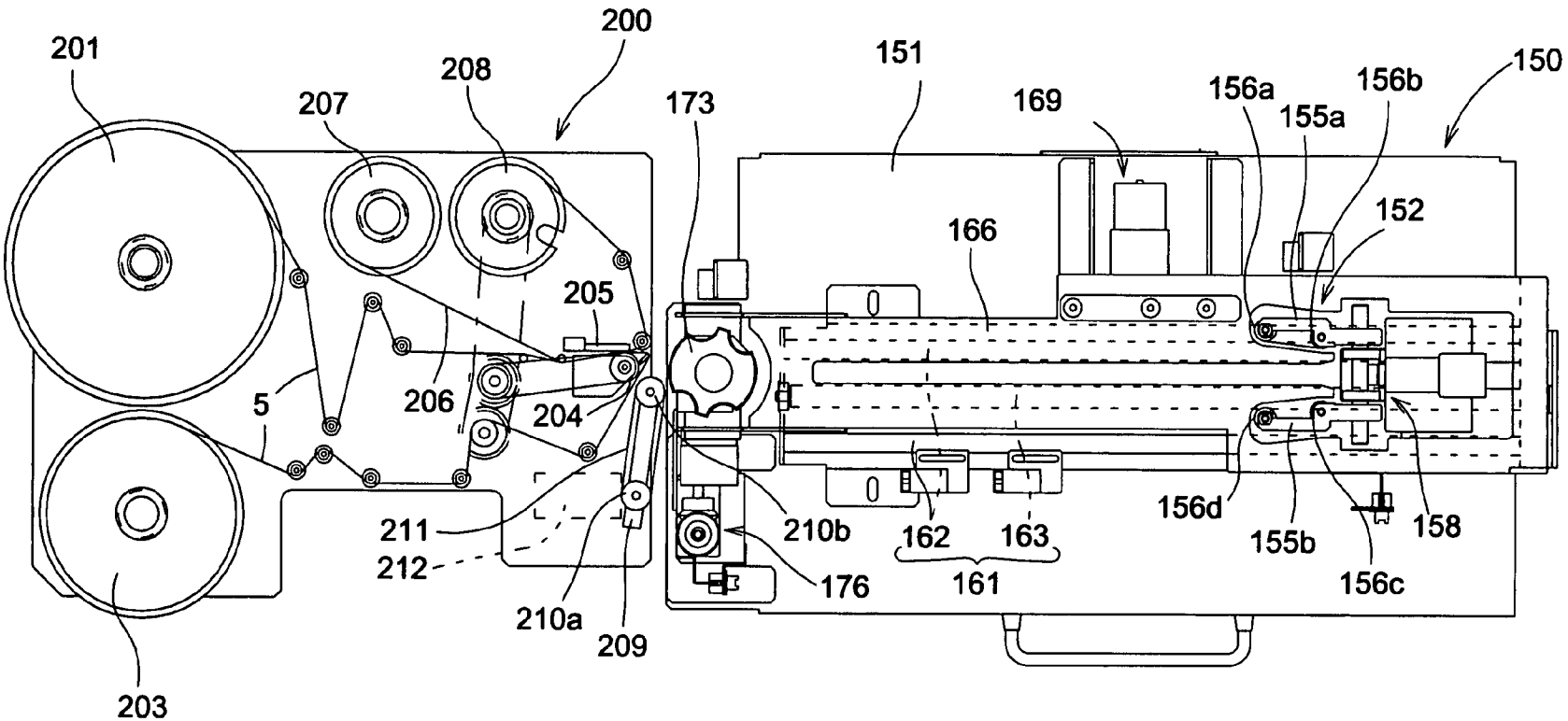
FIG. 11 is a plan view of the first transfer robot and a labeling part.
Figure 12:
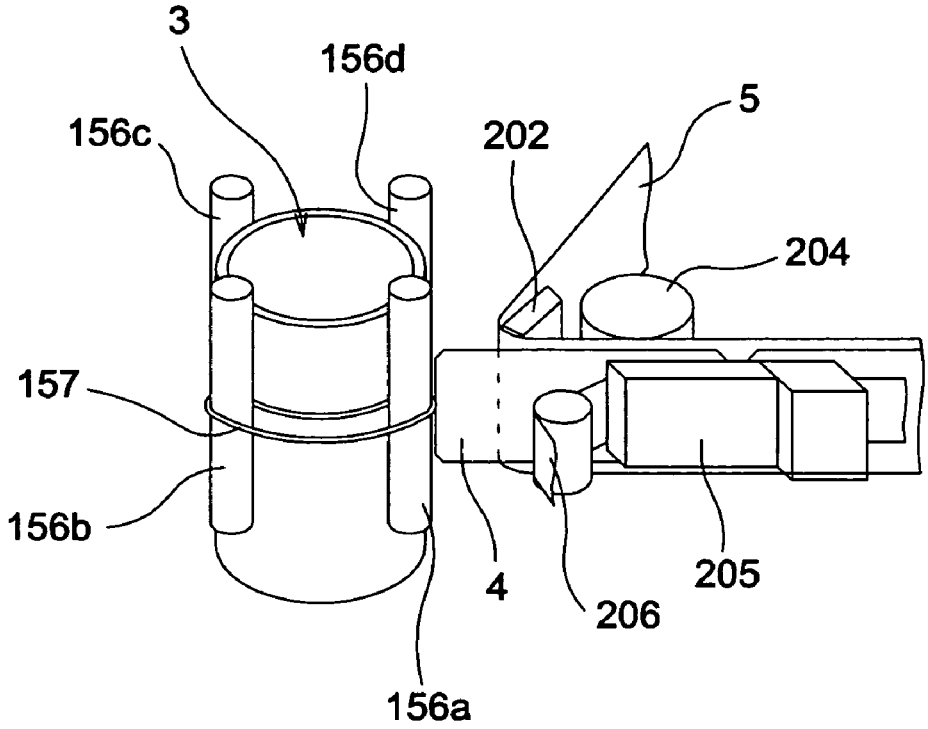
FIG. 12 is a perspective view of the main parts of FIG. 11.

As shown in FIGS. 11 and 12, the labeling part 200 constituting the labeling apparatus supplies the label 4, which is printed with a medicine name and so on, to the outer peripheral surface of the vial 3 so that the label 4 is positioned in front of the direction in which the vial 3 is rotated by vial rotating means, to be described below, at the first support roller 156*a* of the robot arm 152. The label 4 is affixed to a sheet 5 supplied by a first roller 201, and the sheet 5 is peeled away from the label 4 by switching the direction of the sheet 5 using a guide chip 202. Having been peeled away from the label 4, the sheet 5 is wound onto a second roller 203. While being supported by a backing roller 204 before the sheet 5 is peeled away, the label 4 is printed by a print head 205 through thermal transfer of a ribbon 206. The ribbon 206 is supplied from a third roller 207 and wound onto a fourth roller 208.

The labeling part 200 is also provided with the vial rotating means for rotating the vial 3, which is held by the rotatable support rollers 156*a* to 156*d*, in the direction of the first, second, third, and fourth support rollers 156*a* to 156*d*. The vial rotating means is constituted by a rotary substrate 209 which is disposed rotatably, rotary rollers 210*a*, 210*b* disposed rotatably at either end of the rotary substrate 209, a belt 211 which is wrapped around the rotary rollers 210*a*, 210*b*, and a motor 212 for rotating the rotary roller 210*a* disposed at the rotational center of the rotary substrate 209.

The labeling part 200 constituted in this manner is operated by the device control apparatus 802. More specifically, when the robot arm 152 is moved to the end position in the step S155 of the flowchart shown in FIG. 10, the label 4 is printed on the basis of the prescription data. The rotary substrate 209 is then rotated such that the front end rotary roller 210*b* comes into contact with the vial 3 that is supported rotatably by the support rollers 156*a* to 156*d*. In this state, the rotary roller 210*b* is rotated by the motor 212 via the rotary roller 210*a*, whereby the vial 3 is rotated within the support rollers 156*a* to 156*d*.

At this time, the label 4 peeled away from the sheet 5 by the guide chip 202 advances between the support rollers 156*a*, 156*d*, comes into contact with the vial 3, and thus becomes adhered to the outer peripheral surface of the vial 3 by means of an adhesive coated on the label 4. The label 4 is pressed by the first through fourth support rollers 156*a* to 156*d* in sequence so as to become firmly adhered to the entire surface of the vial 3.

Immediately after the label 4 is affixed to the vial 3, the adhesion condition is unstable, and the tip end part of the label 4 is likely to peel away from the vial 3 due to the stiffness of the label 4 itself. In this embodiment, however, the endless member 157 is wrapped around the first support roller 156*a* which the label 4 contacts first and the second support roller 156*b* which is positioned at front side of the rotation direction of the vial 3 and which the label 4 contacts next to the first support roller 156*a*, from among the support rollers 156*a* to 156*d* of the robot arm 152 constituting the labeling apparatus. So, the label 4 can be affixed firmly without peeling away from the vial 3 at the tip end part thereof as the label 4 is guided to the second support rollers 156*b*. Thus, it is possible to surely prevent occurrence of a trouble caused due to that the label with the tip end peeled and free adheres to the push rollers.

Note that the labeling apparatus of the present invention is not limited to the embodiment described above, and may be modified in various ways.

Figure 13:
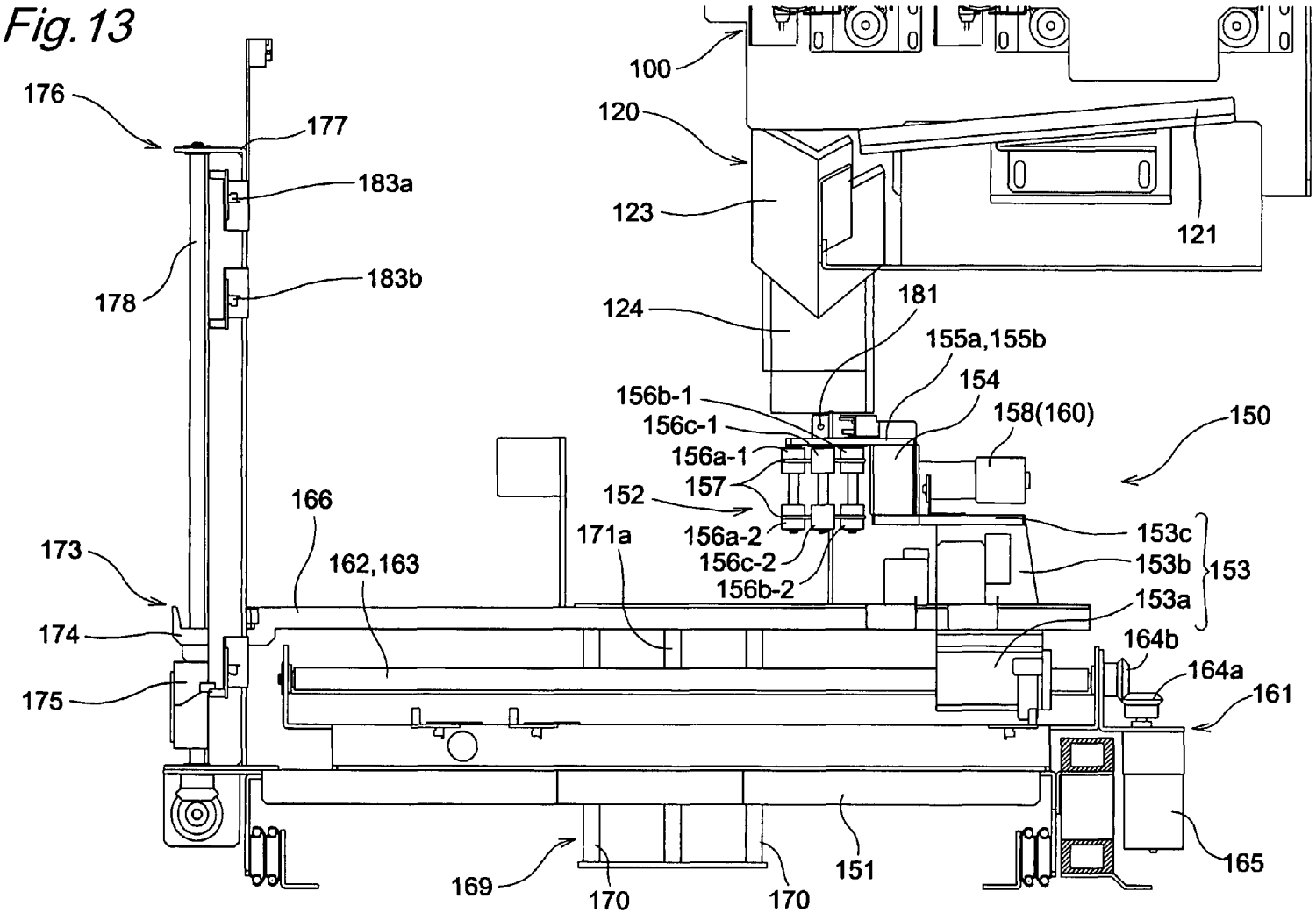
FIG. 13 is a front view of a variation of the first transfer robot constituting the labeling apparatus.
Figure 14:
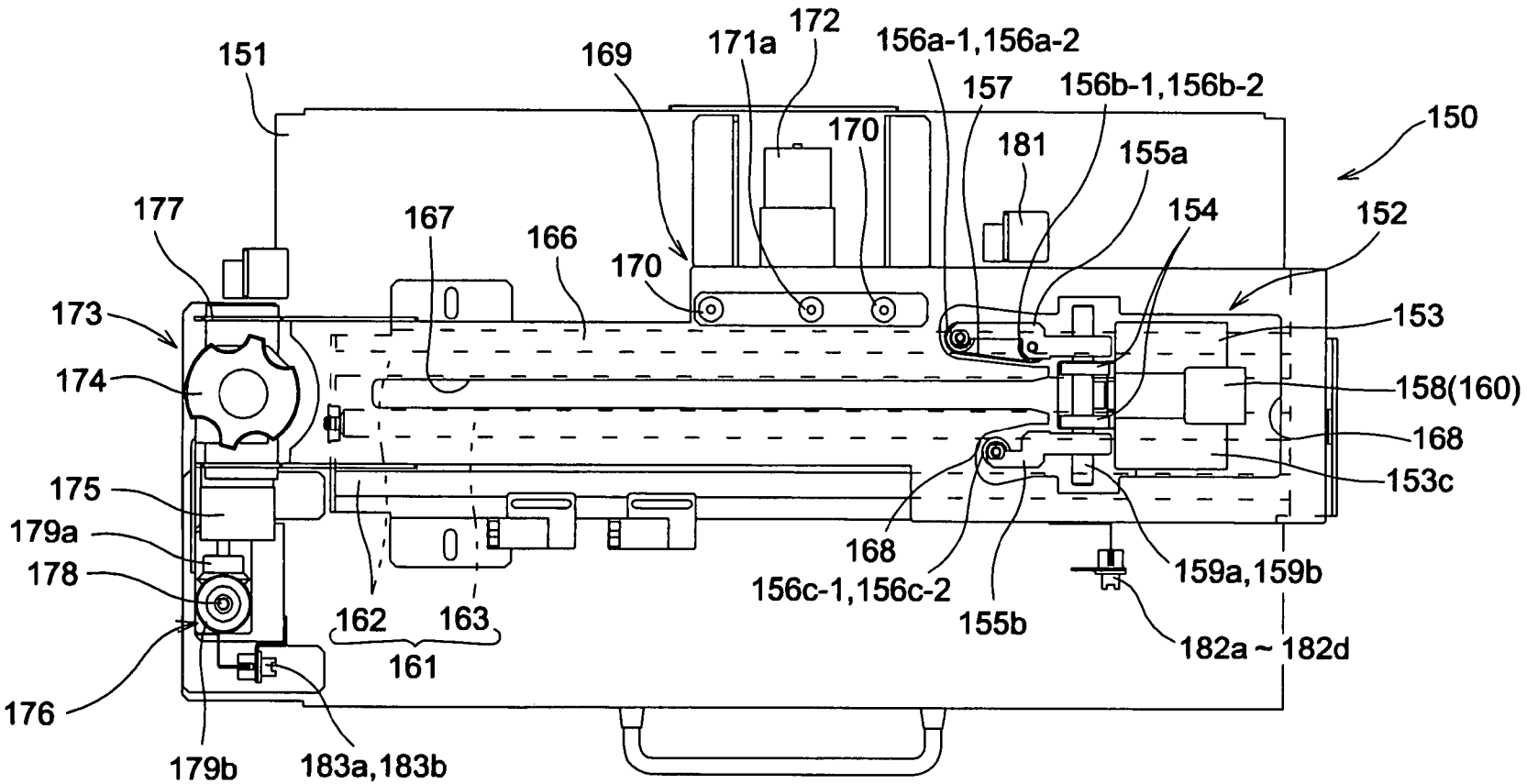
FIG. 14 is a plan view of FIG. 13.

For example, although, in the embodiment described above, the outer surface of the vial 3 is held by four support rollers 156*a*-156*b*, as shown in FIGS. 13, 14, two support rollers 156*a*, 156*b* rotatably attached on a first arm 155*a* and a support roller 156*c* rotatably attached on a second arm 156*c* may be arranged so as to form a triangle. In the arms, five or more support rollers may be attached. That is to say, in order to hold the vial 3 having circular cross section, more than three support rollers are disposed so as to form a locus of circle. Thus, the vial 3 can be centered and held at the center position of the robot arm 152. The endless member 157 is not limited only to providing between the first and second support rollers 156*a*, 156*b*. In the case that five or more support rollers 156 are provided, the endless member 157 may be also provided between the second and third support rollers 156*b*, 156*c*.

Furthermore, each support roller 156 is not limited to one extending vertically along the outer surface of the vial as in the embodiment described above. As shown in FIGS. 13, 14, the support roller 156 may be constructed by divisional rollers 156*a*-1, 156*a*-2 156*b*-1, 156*b*-2, 156*c*-1, 156*c*-2 which are divided into an upper part and a lower part within a range of the height of the vial. Thus, the number of holding positions with respect to the vial 3 can be increased, enhancing stability of holding state.

The invention claimed is:

1. A labeling apparatus, comprising:

at least three support rollers, each support roller of the at least three support rollers being configured to simultaneously come into contact with an outer surface of a vial to hold and rotate the vial;

an arm for rotatably supporting the support rollers;

a rotation unit configured to rotate the vial being held by the support rollers in a predetermined direction;

a label supply unit configured to supply labels to be attached to the outer surface of the vial; and an endless member supported by a first support roller of the at least three support rollers and a second support roller of the at least three support rollers, the endless member being configured to rotate along the outer surface of the vial according to the rotation of the vial between the first support roller and the second support roller, wherein each label fed from the label supply unit comes into contact with the first support roller first, and a tip end of each label that is in an attaching process in accordance with the rotation of the vial comes into contact with the second support roller second, and wherein the endless member is configured and arranged such that each label is supplied between the endless member and the vial.

2. The labeling apparatus as in claim 1, wherein each of the support rollers is divided into an upper part and a lower part within a range of the height of the vial.

3. The labeling apparatus as in claim 1, wherein the endless member is arranged so as to simultaneously contact the vial and the first and second support rollers, as each label is in the attaching process.

4. The labeling apparatus as in claim 1, wherein the endless member is arranged such that during rotation, the vial simultaneously contacts the endless member and the first and second support rollers, as each label is in the attaching process.

5. The labeling apparatus as in claim 1, wherein the endless member is configured and arranged to apply pressure to the label during the attaching process.

6. The labeling apparatus as in claim 1, wherein the endless member is configured and arranged to contact at least a center of the label.

* * * * *